US012532947B2

(12) United States Patent
Thornton

(10) Patent No.: US 12,532,947 B2
(45) Date of Patent: Jan. 27, 2026

(54) CANE CADDY AND METHODS OF MAKING AND USING THE SAME

(71) Applicant: Janet Long Thornton, Columbus, GA (US)

(72) Inventor: Janet Long Thornton, Columbus, GA (US)

( * ) Notice: Subject to any disclaimer, the term of this patent is extended or adjusted under 35 U.S.C. 154(b) by 306 days.

(21) Appl. No.: 18/240,589

(22) Filed: Aug. 31, 2023

(65) Prior Publication Data

US 2024/0074936 A1 Mar. 7, 2024

Related U.S. Application Data

(60) Provisional application No. 63/374,530, filed on Sep. 2, 2022.

(51) Int. Cl.
*A45B 1/00* (2006.01)
*A45B 1/04* (2006.01)

(52) U.S. Cl.
CPC . *A45B 1/00* (2013.01); *A45B 1/04* (2013.01)

(58) Field of Classification Search
CPC ..... A45B 1/00; A45B 1/04; A61H 2003/025; A61H 3/0244; A61H 2003/002
See application file for complete search history.

(56) References Cited

U.S. PATENT DOCUMENTS 3,179,436 A * 4/1965 Choy ..... A45B 5/00 135/66
3,338,627 A 8/1967 Frank
3,338,628 A 8/1967 Evans
3,443,569 A 5/1969 Ernst
3,606,898 A * 9/1971 Harocopo ..... A61H 3/0244 135/68
4,300,742 A 11/1981 Hunn
4,609,175 A 9/1986 Conover
4,779,884 A 10/1988 Minati
D301,976 S 7/1989 Greenhut et al.
4,895,330 A 1/1990 Anstead
5,180,181 A 1/1993 Letechipia
5,456,437 A 10/1995 Chander et al.
5,524,657 A 6/1996 Jih
5,588,663 A 12/1996 Rundle et al.
5,597,148 A 1/1997 Gospodarich
5,626,398 A 5/1997 Wooldridge
5,678,798 A 10/1997 Little
5,996,957 A * 12/1999 Kurtz ..... A47G 23/0225 248/231.21
6,142,350 A 11/2000 Alexander
D437,679 S 2/2001 Lisowski et al.
6,227,511 B1 5/2001 De Costa
6,561,206 B1 * 5/2003 Wilkinson ..... A61H 3/0244 135/65
6,565,053 B1 5/2003 Larky
6,651,946 B1 11/2003 Thornton
(Continued)

FOREIGN PATENT DOCUMENTS

BE 1011340 A3 * 7/1999 ..... A61H 3/0244
WO WO-2004086897 A1 * 10/2004 ..... A45F 5/1566
WO WO-2014115085 A1 * 7/2014 ..... A61H 3/0244

*Primary Examiner* — Noah Chandler Hawk
(74) *Attorney, Agent, or Firm* — Judy Jarecki-Black; Sharon Ngwenya

(57) ABSTRACT

A cane caddy device is provided. The methods of making and using the cane caddy device are also provided.

13 Claims, 2 Drawing Sheets

(56) References Cited

U.S. PATENT DOCUMENTS

| | | | | |
|---|---|---|---|---|
| 10,588,812 | B2 * | 3/2020 | Brockway | A61H 3/00 |
| 2005/0098695 | A1 * | 5/2005 | Hollenbeck | A61H 3/0244<br>248/229.26 |

* cited by examiner

CANE CADDY AND METHODS OF MAKING AND USING THE SAME

CROSS REFERENCE TO RELATED APPLICATIONS

This application claims priority to and benefit of U.S. Provisional Application No. 63/374,530, filed on Sep. 2, 2022, which is incorporated by reference in its entirety.

FIELD OF THE INVENTION

Embodiments described herein generally relate to a cane caddy device. More particularly, such embodiments relate to a cane caddy and methods of making and using the same.

BACKGROUND OF THE INVENTION

Many people who use a wheelchair for help in moving can ambulate at least for short distances using a walking cane. Most wheelchair do not have a place to store a walking cane and, even those wheelchairs that do have a cane holder to assist in storing the cane while the person is using the wheelchair to move, are not without issues. For example, a majority of the cane holders on the market attach to the back of a wheelchair seat or on the back handles of a wheelchair. This placement requires the person to lean to attempt to access the cane, consequently putting the person in a precarious position and possibly causing an injury to occur as the person leans and twists to reach the cane.

The present invention eliminates the risk associated with activities such as reaching for a cane or the cane catching in the wheelchair as the person attempts to retrieve it, triggering a fall. The invention of the present Application is directed to a cane holding device, or cane caddy, that can be easily attached to existing wheelchairs without requiring modification of the existing wheelchair. The caddy helps to decrease the risk of an injury sustained by the person as they transfer in and out of the wheelchair. Additionally, a caddy made in accordance with the present invention eliminates excessive bending and leaning by the user by providing an easily accessible holding place on the wheelchair to hold a walking cane.

Accordingly, a need exists for a cane caddy with improved safety, has easy installation, increased accessibility, provides greater security for the cane and is cost-effective.

In light of the above, it would be desirable to develop a cane caddy which is safe and easy to install on the wheelchair. Furthermore, it would be desirable to develop a user-friendly cane caddy which permits the user to easily reach and use the cane.

Therefore, it is a main object of the present invention to provide to the user the improved safety of a cane caddy that requires no assembly.

It is an object of the present invention to provide a cane caddy that attaches conveniently to the accessible area on the wheelchair and is easy to operate.

It is another object of the present invention to provide a cane caddy with increased accessibility and functionality.

It is still another object of the present invention to provide greater security for the cane and adjustable angle positioning of the cane.

It is also an object of the present invention to provide a cane caddy made of durable, lightweight and nonabrasive material.

It is a further object of the present invention to provide a cane caddy which is inexpensive to make, safe to install on chair, walker or any device and user-friendly for the person to access and use.

These needs and other needs are met by the various aspects of the present disclosure.

SUMMARY OF THE INVENTION

In accordance with the purpose(s) of this invention, as embodied and broadly described herein, this invention, in one aspect, relates to a cane caddy device and methods of making and using the same.

In some embodiments of the present invention, a cane holding device or cane caddy can include a locking clamp; an extension tube; a cane holding crescent shape; and a cane sleeve. In an aspect, the locking clamp attaches to an article. The extension tube terminating at one end in the locking clamp and at the opposite end in the cane holding crescent shape. The extension tube made from two halves having a radially geared mating surface at the location where the halves meet and a threaded locking bolt within the extension tube that allows the halves to be locked together at any desired angle. The cane holding crescent shape has a removable and replaceable metal member that plugs into one end of the extension tube. The cane holding crescent shape, having a plurality of magnetic members fixedly embedded along the inside surface. The cane sleeve is capable of frictionally sliding onto a standard walking cane. The magnetic member and the metal member are held together via magnetic forces.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The drawings constitute a part of this specification and include exemplary embodiments of the present invention illustrating various objects and features thereof.

DETAILED DESCRIPTION OF THE INVENTION

Figure 1:
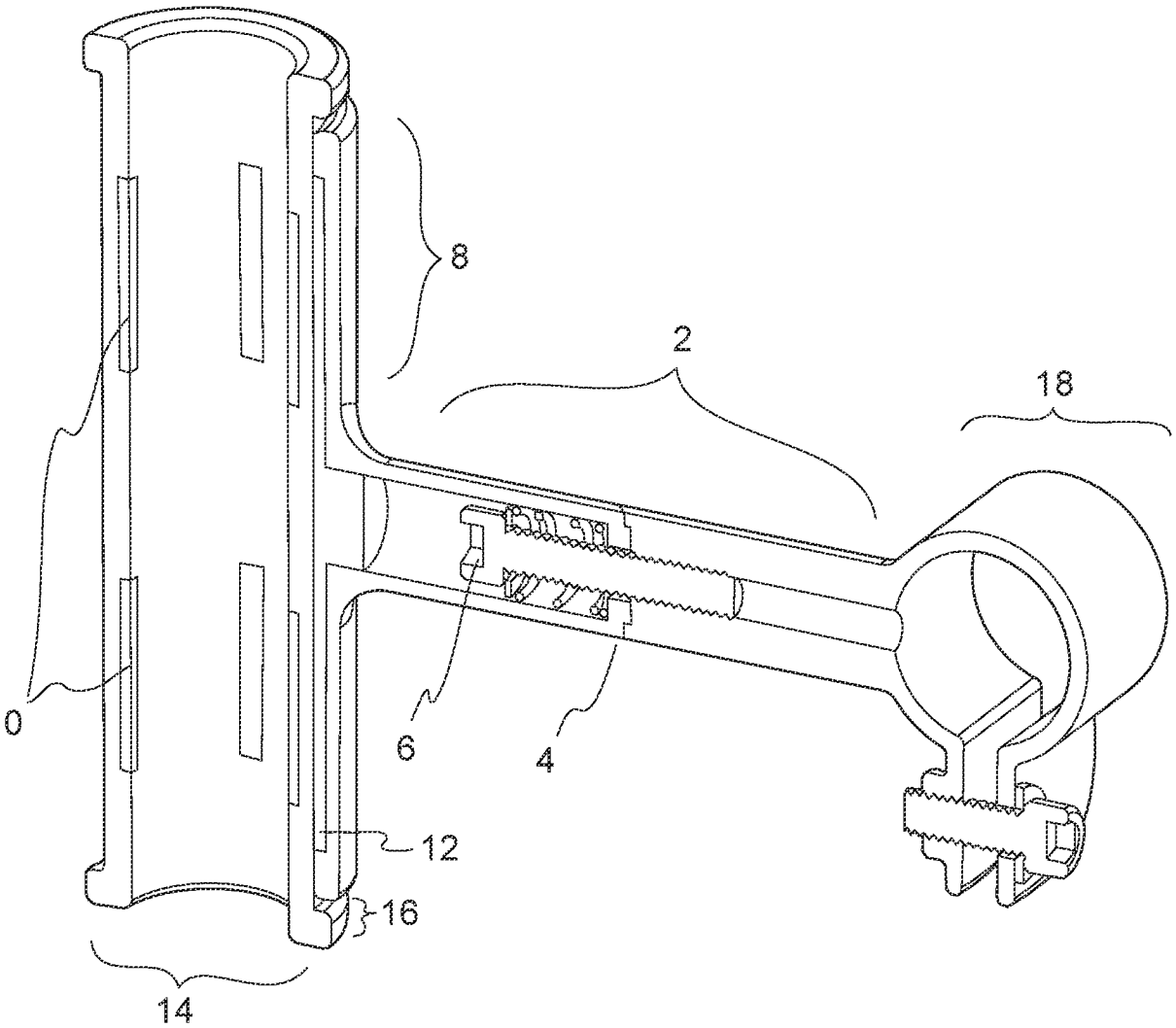
FIG. 1 is a schematic view of the cane holding device of the preferred embodiment showing a locking clamp, an extension tube, a cane holding crescent shape, and a cane sleeve.

The present invention is directed to a device for holding a cane and more particularly, a cane caddy and methods of making and using the same. The present invention may be understood more readily by reference to the following detailed description of preferred embodiments of the invention and the Examples included therein and to the Figures and their previous and following description.

The present invention will now be described more fully hereinafter with reference to the accompanying drawings, in which a preferred embodiment of the invention is shown.

This invention may, however, be embodied in many different forms and should not be construed as limited to the embodiments set forth herein. Rather, these embodiments are provided so that this disclosure will be thorough and complete and will fully convey the scope of the invention to those skilled in the art. In the drawings, like numbers refer to like elements throughout.

The cane caddy device shown in the figures has parts that are examples of the elements recited in the claims. The cane caddy device thus includes examples of how a person of ordinary skilled in the art can make and use the claimed invention. It is described here to meet the requirements of enablement and best mode without imposing limitations that are not specified in the claims.

In embodiments of the present invention, a cane holding device, or cane caddy, can include a locking clamp; an extension tube; a cane holding crescent shape; and a cane sleeve, wherein the locking clamp attaches to an article, wherein the extension tube terminating at one end in the locking clamp and at the opposite end in the cane holding crescent shape, wherein the extension tube made from two halves having a radially geared mating surface at the location where the halves meet and a threaded locking bolt within the extension tube that allows the halves to be locked together at any desired angle, wherein the cane holding crescent shape has a removable and replaceable metal member that plugs into one end of the extension tube, wherein the cane holding crescent shape, having a plurality of magnetic members fixedly embedded along the inside surface, wherein the cane sleeve is capable of frictionally sliding onto a standard walking cane, and wherein the magnetic member and the metal member are held together via magnetic forces.

In one embodiment, the extension tube is a two-piece extension tube.

In certain embodiments, the length of the extension tube ranges from about 30 inches to about 40 inches.

In other embodiments, the cane holding crescent shape metal member can include an iron metal.

In another embodiment, the diameter of the locking clamp ranges from about 0.5 inch to about 15 inch.

In one embodiments, the cane sleeve is made up of a resilient material.

In some embodiments, the resilient material selected from the group consisting of plastic, rubber, silicon, wood, metal, ceramic, leather, fabric, organic material, inorganic material, or organometallic material and combinations thereof.

In other embodiments, the locking clamp is made of a material selected from the group consisting of metal, plastic, wood and combinations thereof.

In certain embodiments, the extension tube is made of a material selected from the group consisting of metal, plastic, wood and combinations thereof.

In further embodiments, the article is selected from the group consisting of a wheelchair, a walker, a rollator or a device that needs support and combinations thereof.

In certain embodiments, the wheelchair is selected from the group consisting of a manual wheelchair, an electric wheelchair or a power chair and combinations thereof.

In another embodiment, the device can be used at a destination.

In further embodiments, the destination is selected from the group consisting of an airline, an airport, a bus, a train, a ship, a cruise, a hospital, a nursing home, a senior citizen center, a rehabilitation center, a wheelchair manufacturer, or a walker manufacturer and combinations thereof.

FIG. 1 illustrates a cane holding device in accord with the present invention. The cane holding device 100 of the preferred embodiment shows a locking clamp 18, an extension tube 2, a cane holding crescent shape 8, and a cane sleeve 14. The cane holding crescent shape 8 has magnetic members 10, and metal members 12. The magnetic members vary in strength to accommodate the various walking cane weights. The extension tube 2 has locking bolt 6 and locking gear teeth 4 within the extension tube 2. The locking gear teeth 4 can have any type of springs that make the extension tube 2 stronger and flexible. The cane sleeve 14 has a cane sleeve shoulder 16.

In some embodiments of the invention, the cane holding device 100 includes a locking clamp 18, an extension tube 2, a cane holding crescent shape 8 and a cane sleeve 14, as shown in FIG. 1. The locking clamp 18 attaches to an article (a wheelchair, a walker, or a rollator). The extension tube 2 is a two-piece extension tube, which is connected at one end to the locking clamp 18 and at the opposite end to the cane holding crescent shape 8. The extension tube 2 has locking bolt 6 and locking gear teeth 4 within the extension tube 2. The cane holding crescent shape 8 has a removable and replaceable metal member 12 that plugs into one end towards the extension tube 2. The cane holding crescent shape 8, having a plurality of magnetic members 10 fixedly embedded along the inside surface. The cane sleeve 14 has a cane sleeve shoulder 16. The cane sleeve 14 is capable of frictionally sliding onto a standard walking cane.

In other embodiments of the invention, the locking clamp 18 of the cane holding device 100 attaches conveniently to the accessible area on an article and has adjustable angle positioning. The article is selected from the group consisting of a wheelchair, a walker, a rollator or a device that needs support and combinations thereof. Thus, the locking clamp 18 can be easily attached to a wheelchair, a walker, or a rollator. The extension tube 2 terminating at one end in the locking clamp 18 and at the opposite end in the cane holding crescent shape 8. The extension tube 2 made from two halves having a radially geared mating surface at the location, where the halves meet and has a threaded locking bolt 6 and locking gear teeth 4 within the extension tube 2 that allows the halves to be locked together at any desired angle. The cane holding crescent shape 8 has a removable and replaceable metal member 12 that plugs into one end towards the extension tube 2. The cane holding crescent shape 8, having a plurality of magnetic members 10 fixedly embedded along the inside surface. The cane sleeve 14 has a cane sleeve shoulder 16. The cane sleeve 14 is made up of a resilient material and is capable of frictionally sliding onto a standard walking cane. The magnetic member 10 and the metal member 12 of the cane holding crescent shape 8 are held together via magnetic forces when the cane sleeve 14 is slid onto a standard walking cane.

In certain embodiments of the invention, the diameter of the locking clamp 18 ranges from about 0.5 inch to about 15 inch, preferably, the diameter of the locking clamp 18 ranges from about 0.6 inch to about 10 inch, more preferably, the diameter of the locking clamp 18 ranges from about 0.75 inch to about 5 inch. The locking clamp 18 is made of a material selected from the group consisting of metal, plastic, wood and combinations thereof. In some embodiments, the length of the extension tube 2 ranges from about 30 inches to about 40 inches, preferably, the length of the extension tube 2 ranges from about 35 inches to about 39 inches, and more preferably, the length of the extension tube 2 ranges from about 34 inches to about 38 inches. The extension tube 2 is made of a material selected from the group consisting of metal, plastic, wood and combinations thereof. In one embodiment, cane holding crescent shape 8 metal member can include an iron metal. In other embodiments, the cane sleeve 14 is made up of a resilient material. The resilient material selected from the group consisting of plastic, rubber, silicon, wood, metal, ceramic, leather, fabric, organic material, inorganic material, or organometallic material and combinations thereof.

Figure 2:
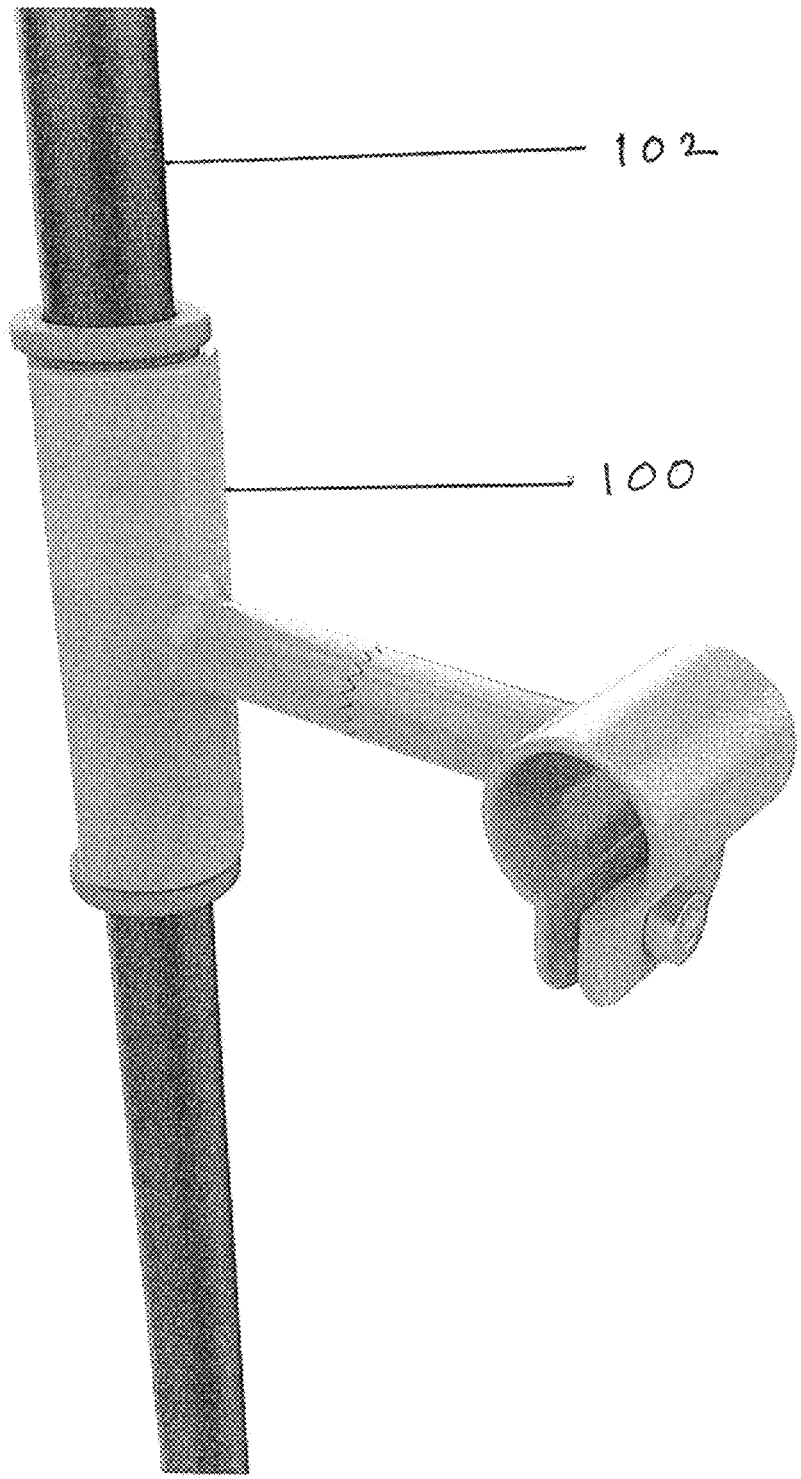
FIG. 2 shows a schematic view of the cane holding device holding a standard walking cane.

In further embodiments, FIG. 2 shows a schematic view of the cane holding device 100 holding a standard walking cane 102.

INDUSTRIAL APPLICATIONS

A cane caddy device of the present invention offers several industrial applications including but not limited to, improved safety, increased ease of installation, increased accessibility, greater security for holding the cane and cost-effectiveness for the manufacture. The Cane caddy device of the present invention requires no assembling, but in some embodiments, it may require screwing the clamp to the arm of the chair and is user-friendly for the user with ease of operation and more secure holding of the cane. The device attaches conveniently to the accessible area on the wheelchair and has adjustable angle positioning. The cane caddy device can be easily attached to a wheelchair, a walker, a rollator or a device that needs support and combinations thereof. Further, a cane caddy device of the present invention can be used at various destination including but not limited to, an airline, an airport, a bus, a train, a ship, a cruise, a hospital, a nursing home, a senior citizen center, a rehabilitation center, a wheelchair manufacturer, or a walker manufacturer and combinations thereof.

While in the foregoing specification this invention has been described in relation to certain embodiments thereof, and many details have been put forth for the purpose of illustration, it will be apparent to those skilled in the art that the invention includes additional embodiments and that certain of the details described herein can be varied considerably without departing from the basic principles of the invention. Although we have described the preferred embodiments for implementing our invention, it will be understood by those skilled in the art to which this disclosure is directed that modifications and additions may be made to our invention without departing from its scope.

All references cited herein are incorporated by reference in their entirety. The present invention may be embodied in other specific forms without departing from the spirit or essential attributes thereof and, accordingly, reference should be made to the appended claims, rather than to the foregoing specification, as indicating the scope of the invention.

What is claimed is:

1. A cane holding device comprising:

a locking clamp;

an extension tube;

a cane holding crescent shape; and a cane sleeve, wherein the locking clamp attaches to an article, wherein the extension tube terminating at one end in the locking clamp and at the opposite end in the cane holding crescent shape, wherein the extension tube made from two halves having a radially geared mating surface at the location where the halves meet and a threaded locking bolt within the extension tube that allows the halves to be locked together at any desired angle, wherein the cane holding crescent shape has a removable and replaceable metal member that plugs into one end towards the extension tube, wherein the cane holding crescent shape, having a plurality of magnetic members fixedly embedded along the inside surface, wherein the cane sleeve is capable of frictionally sliding onto a standard walking cane, and wherein the magnetic member and the metal member are held together via magnetic forces.

2. The cane holding device of claim 1, wherein the extension tube is a two-piece extension tube.

3. The cane holding device of claim 1, wherein the length of the extension tube ranges from about 30 inches to about 40 inches.

4. The cane holding device of claim 1, wherein the cane holding crescent shape metal member comprises an iron metal.

5. The cane holding device of claim 1, wherein the diameter of the locking clamp ranges from about 0.5 inch to about 15 inch.

6. The cane holding device of claim 1, wherein the cane sleeve is made up of a resilient material.

7. The cane holding device of claim 6, wherein the resilient material selected from the group consisting of plastic, rubber, silicon, wood, metal, ceramic, leather, fabric, organic material, inorganic material, or organometallic material and combinations thereof.

8. The cane holding device of claim 1, wherein the locking clamp is made of a material selected from the group consisting of metal, plastic, wood and combinations thereof.

9. The cane holding device of claim 1, wherein the extension tube is made of a material selected from the group consisting of metal, plastic, wood and combinations thereof.

10. The cane holding device of claim 1, wherein the article is selected from the group consisting of a wheelchair, a walker, a rollator or a device that needs support and combinations thereof.

11. The cane holding device of claim 10, wherein the wheelchair is selected from the group consisting of a manual wheelchair, an electric wheelchair or a power chair and combinations thereof.

12. The cane holding device of claim 1, wherein the device can be used at a destination.

13. The cane holding device of claim 12, wherein the destination is selected from the group consisting of an airline, an airport, a bus, a train, a ship, a cruise, a hospital, a nursing home, a senior citizen center, a rehabilitation center, a wheelchair manufacturer, or a walker manufacturer and combinations thereof.

* * * * *